US010238257B2

(12) United States Patent
Jareczek

(10) Patent No.: US 10,238,257 B2
(45) Date of Patent: Mar. 26, 2019

(54) VACUUM ATTACHMENT INCLUDING A PRESSURIZED AIR SOURCE

(71) Applicant: Brad Jareczek, Sleepy Hollow, IL (US)

(72) Inventor: Brad Jareczek, Sleepy Hollow, IL (US)

( * ) Notice: Subject to any disclaimer, the term of this patent is extended or adjusted under 35 U.S.C. 154(b) by 1077 days.

(21) Appl. No.: 14/078,516

(22) Filed: Nov. 12, 2013

(65) Prior Publication Data

US 2014/0251380 A1 Sep. 11, 2014

Related U.S. Application Data

(60) Provisional application No. 61/811,840, filed on Apr. 15, 2013, provisional application No. 61/773,767, filed on Mar. 6, 2013.

(51) Int. Cl.

| | |
|---|---|
| ***A47L 9/02*** | (2006.01) |
| ***A47L 9/08*** | (2006.01) |
| *A47L 9/00* | (2006.01) |

(52) U.S. Cl.

CPC *A47L 9/08* (2013.01); *A47L 9/02* (2013.01); *A47L 9/00* (2013.01)

(58) Field of Classification Search

CPC ..... A47L 9/08; A47L 9/00

USPC ..... 15/246.2, 330

See application file for complete search history.

(56) References Cited

U.S. PATENT DOCUMENTS

| | | | | | |
|---|---|---|---|---|---|
| 4,325,163 | A * | 4/1982 | Mattson | A47L 5/14 | 15/330 |
| 4,694,528 | A * | 9/1987 | Comer | A47L 5/14 | 15/330 |
| 4,870,714 | A * | 10/1989 | Miner | A47L 5/14 | 15/327.5 |
| 5,195,209 | A * | 3/1993 | Watkins | A47L 5/36 | 15/327.5 |
| 5,222,275 | A * | 6/1993 | Baker | A47L 5/14 | 15/329 |
| 5,305,494 | A * | 4/1994 | Candler | A47L 7/00 | 118/326 |
| 5,477,585 | A * | 12/1995 | Hentzschel | A47L 5/14 | 15/330 |
| 5,560,078 | A * | 10/1996 | Toensing | A47L 5/14 | 15/339 |
| 5,640,739 | A * | 6/1997 | Campbell | A47L 11/34 | 15/321 |
| 6,206,980 | B1 * | 3/2001 | Robinson | A47L 11/30 | 134/21 |
| 6,247,876 | B1 * | 6/2001 | Stephens | B65G 53/28 | 406/39 |
| 6,305,909 | B1 * | 10/2001 | Jankowski | A47L 5/14 | 417/234 |
| 6,442,790 | B1 * | 9/2002 | Svoboda | A47L 5/14 | 15/330 |
| 6,640,384 | B2 * | 11/2003 | Sanders | A47L 5/14 | 15/330 |

(Continued)

*Primary Examiner* — Michael Jennings

(74) *Attorney, Agent, or Firm* — Richards Patent Law P.C.

(57) ABSTRACT

The present disclosure provides a vacuum attachment comprising a body including an adaptor configured to connect to a vacuum assembly, a vacuum airflow path configured to be in fluid communication with the vacuum assembly, and a dispensing airflow path configured to be in fluid communication with a pressurized gas source.

17 Claims, 5 Drawing Sheets

(56) References Cited

U.S. PATENT DOCUMENTS

| | | | | |
|---|---|---|---|---|
| 6,735,813 | B2 * | 5/2004 | Oohama | A47L 5/14 15/327.5 |
| 6,938,838 | B2 * | 9/2005 | Kawamoto | A47K 7/04 239/504 |
| 7,334,742 | B2 * | 2/2008 | Jahnke | B05B 14/00 239/120 |
| 7,735,188 | B2 * | 6/2010 | Shaffer | E01H 1/0809 15/339 |
| 7,837,130 | B1 * | 11/2010 | Lowery | B01D 46/10 239/120 |
| 7,870,640 | B2 * | 1/2011 | Hinklin | A47L 5/14 15/330 |
| 8,166,607 | B2 * | 5/2012 | Conrad | A47L 5/225 15/331 |
| 8,943,645 | B2 * | 2/2015 | Osterchill | A47L 5/14 15/330 |
| 2003/0066159 | A1 * | 4/2003 | Sanders | A47L 5/14 15/405 |
| 2006/0018722 | A1 * | 1/2006 | Tasker | A47L 5/36 406/38 |
| 2010/0218340 | A1 * | 9/2010 | Sepke | A47L 5/32 15/410 |
| 2012/0000030 | A1 * | 1/2012 | Conrad | A47L 5/24 15/329 |

* cited by examiner

VACUUM ATTACHMENT INCLUDING A PRESSURIZED AIR SOURCE

CROSS-REFERENCE TO RELATED APPLICATIONS

This application incorporates by reference and claims priority to U.S. Provisional Application No. 61/773,767, filed on Mar. 6, 2013, and U.S. Provisional Application No. 61/811,840, filed on Apr. 15, 2013.

BACKGROUND OF THE INVENTION

The present subject matter relates generally to vacuum attachment devices designed to remove dust and debris from surfaces. More specifically, the present subject matter relates to vacuum attachments that include a pressurized air source to simultaneously provide a pressurized blast of air to dislodge target dust and debris from its resting position while pulling a vacuum to capture and dispose of the displaced dust and debris.

Cleaning dust from household surfaces manages to be a tedious and difficult task. For example, removing dust from surfaces that house numerous small items, such as collectables, memorabilia, or other trinkets typically requires the user to remove all of the items, dust the surface, and then reposition of the items on the surface. In addition, removing the dust from the items themselves requires dusting of each individual item, typically with a cloth and cleaning or polishing solution.

Typical dusters, such as feather dusters or compressed air, merely move dust around but do not capture the dust. In addition, typical dusters cannot get into hard to reach places such as behind books on a bookshelf, in between DVDs, between and around stereo components, or top surfaces of ceiling fans.

Typical vacuum cleaners are designed for vacuum cleaning functions rather than dust removal from delicate or difficult to reach surfaces. As such, typical vacuums do not pull a strong enough vacuum to remove dust and debris that might be stuck to the surface being cleaned. Further, notwithstanding the multiple attachments designed to clean various small spaces, the vacuum equipped with the attachments requires actual contact with the surface to be cleaned, which is often not feasible with a surface containing many items, most of which will be knocked over by vacuum attachment during cleaning.

Accordingly, there is a need for a vacuum attachment device that is capable of dislodging and capturing dust from various surfaces without requiring the items on the surface to be removed, as described and claimed herein.

BRIEF SUMMARY OF THE INVENTION

The present disclosure provides vacuum attachment devices configured to dispense compressed air to dislodge dust and debris from surfaces while simultaneously drawing a vacuum to capture the dislodged dust and debris. Various examples of the device and method are provided herein.

In an embodiment, the vacuum attachment includes a body including an adaptor configured to connect to a vacuum assembly. The body also includes a vacuum airflow path configured to be in fluid communication with the vacuum assembly, and a dispensing airflow path configured to be in fluid communication with a pressurized gas source. In a specific example, the body may be in the shape of an "L." However, it is contemplated that there are a wide range of shapes in which the inventive concepts provided herein may be embodied.

In an embodiment, the vacuum attachment is an attachment to a conventional vacuum apparatus. The vacuum attachment may be configured to simultaneously draw a vacuum through the vacuum airflow path and dispense pressurized gas through the dispensing airflow path. For example, the dispensing airflow path may be configured to dislodge dust from a surface and wherein the vacuum airflow path may be configured to capture the dust particles dislodged by the pressurized gas.

The vacuum attachment may further include a gas source adapter configured to receive a pressurized gas source. For example, the pressurized gas source may be a compressed air duster canister. The vacuum attachment may further include a trigger, wherein, upon engaging the trigger, the trigger is configured to dispense pressurized air from the pressurized gas source through the dispensing airflow path.

At least a portion of an outer surface of the body may be configured to be used as a handle by a user. In one example, the handle surrounds the vacuum airflow path. Alternatively, the vacuum airflow path and handle may be located in separate portions of the body. For example, the body may provide a vacuum airflow path that passes above the handle. Further, there may be examples of the vacuum attachment that do not include a distinct handle portion.

The vacuum airflow path may extend from a first end of the body to a second end of the body, wherein the second end of the body includes a vacuum adaptor. The dispensing airflow path may extend from the gas source adapter to the first end. The first end may be configured to receive an extension accessory configured to extend the distance between the first end and second end, increasing the reach of the vacuum attachment.

The disclosure also provides a method of dusting including providing a dusting device that includes a body including an adaptor configured to connect to a vacuum assembly. The dusting device further includes a vacuum airflow path configured to be in fluid communication with the vacuum assembly and a dispensing airflow path configured to be in fluid communication with a pressurized gas source. The method includes attaching a vacuum assembly to the vacuum adaptor of the dusting device and activating the vacuum assembly to draw a vacuum through the vacuum airflow path. The method further includes dispensing pressurized gas through the dispensing airflow path onto a surface to be cleaned, dislodging dust and debris from the surface into the air, and capturing at least a portion of the dislodged dust and debris into the vacuum air flow path. The step of dispensing pressurized gas may include engaging a trigger wherein, upon engaging the trigger, the trigger is configured to dispense pressurized gas from the pressurized gas source through the dispensing airflow path.

An advantage of the present devices is that it provides a convenient attachment to any conventional vacuum, such that the user does not have to purchase an entirely new vacuum system.

A further advantage of the present invention is that it provides a dusting device that does not require a user to remove all objects from a surface before and after dusting.

Another advantage of the present device is that it allows a touch-free method of cleaning such that surfaces will not be scratched or subject to harsh cleaners.

Another advantage of the present device is that it does not just move the dust around, but rather removes the dust from the surface and surrounding air.

Yet another advantage of the present device is that it provides safe and effective method dusting of electronics and hard to reach places, such as ceiling fans motor encasements.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1A:
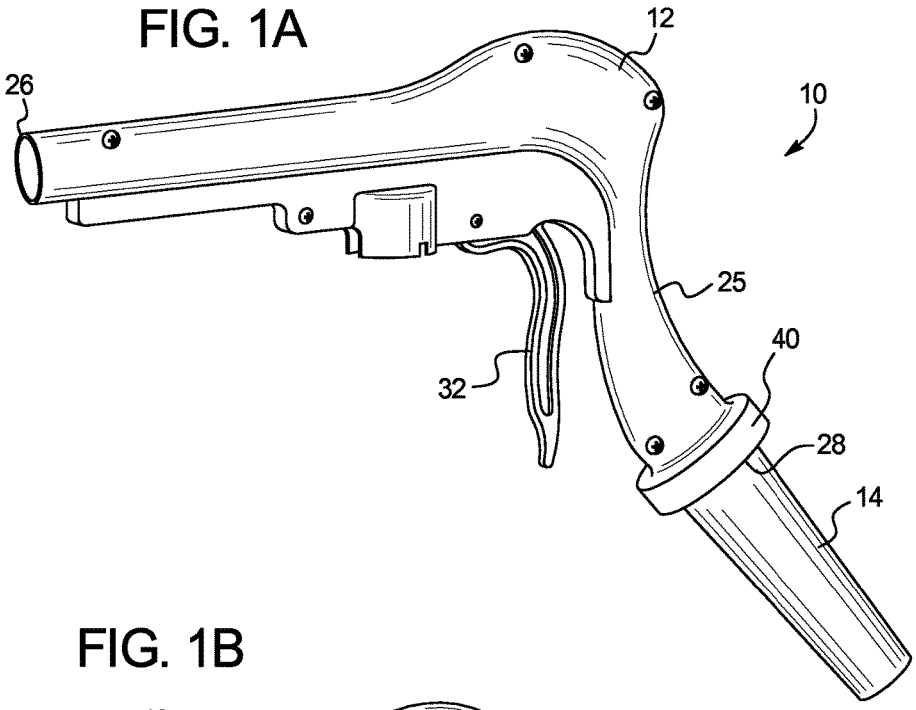
FIG. 1A is a perspective view of an embodiment of the vacuum attachment disclosed herein, wherein the adaptor is engaged with the body of the vacuum attachment.
Figure 8:
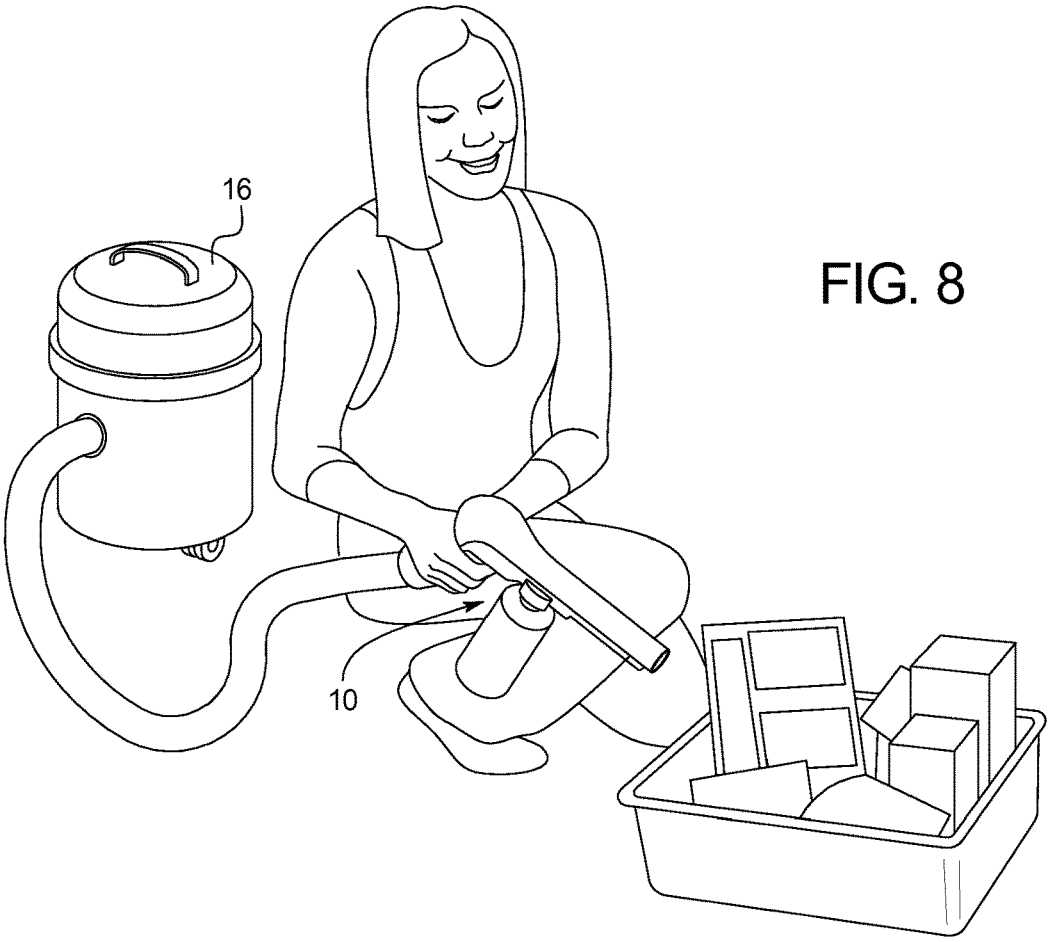
FIG. 8 is a schematic of a person using the vacuum attachment disclosed herein.

The present disclosure provides a vacuum attachment 10 that includes a body 12 including a vacuum adaptor 14 configured to connect to a vacuum assembly 16, as shown in FIGS. 1A and 8. As described below, for clarity and consistency, the term "vacuum attachment" is used throughout the description but it should be understood that the vacuum attachment 10 may be an attachment, an extension, integrated within a vacuum assembly 16, or separately removeable from the vacuum assembly 16.

Figure 1B:
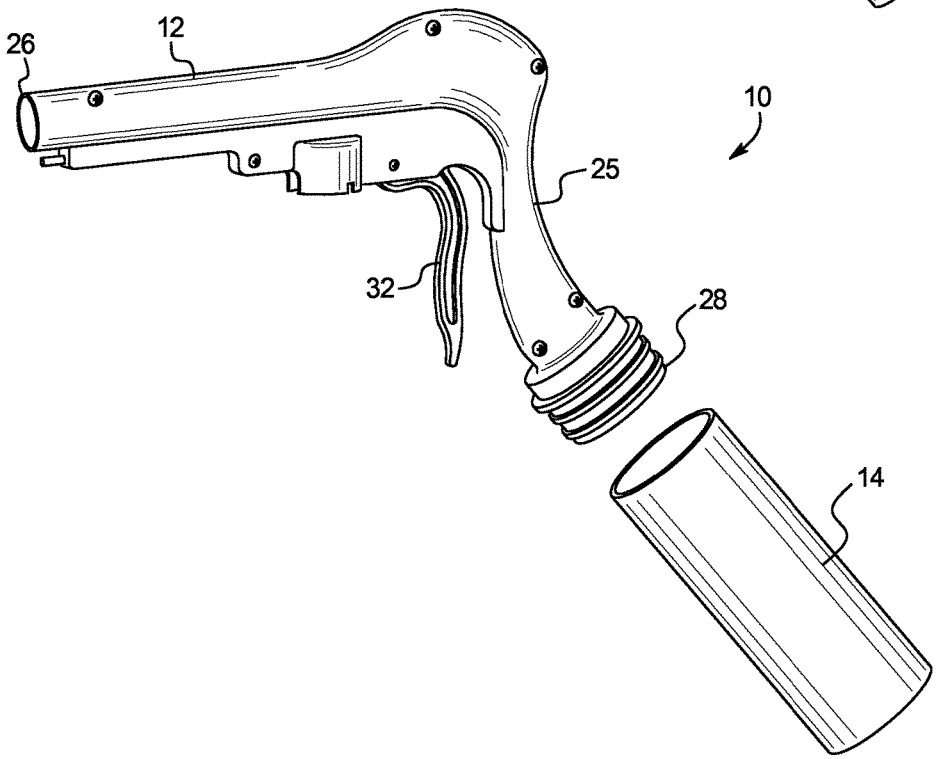
FIG. 1B is a perspective view of the vacuum attachment disclosed herein, wherein the adaptor is shown to insert over the body of the vacuum attachment.

The vacuum adaptor 14 may be any suitable adaptor designed to connect to a vacuum assembly 16, such as a universal hose adaptor, as shown in FIG. 1B. The vacuum adaptor 14 may be detachable from the body 12 or, alternatively, the vacuum adaptor 14 may be an extension of the body 12 that may include one end that is removably attached to a vacuum assembly 16. For example, the vacuum adaptor 14 may be configured such that one end of the vacuum adaptor 14 is configured to removably attach to the body 12 and the other end of the vacuum adaptor 14 is configured to removably attach to a vacuum hose of a vacuum assembly 16.

The vacuum adaptor 14 may include conical ends that enable, for example, one end of the adaptor 14 to be inserted into or over a vacuum hose and form a temporary seal. Similarly, the adaptor 14 may have a second conical end that is inserted into or over a cylindrical opening in the body 12 in order to form a temporary seal. As shown in FIG. 1B, the adaptor 14 fits over a second end 28 of the body 12 that may include plastic or rubber ridges that facilitate a temporary seal between the body 12 and the adaptor 14.

The vacuum assembly 16 may be any conventional vacuum device, such as a household vacuum cleaner. As such, the user of device 10 does not have to purchase a new vacuum assembly in order to dust between hard to reach surfaces. Essentially, the dusting device 10 disclosed herein is an attachment to any conventional vacuum device. Moreover, while described as a vacuum attachment 10 that is distinct and removable from a vacuum assembly, it is contemplated that various embodiments of the vacuum attachment 10 may be integrally formed with a vacuum assembly or otherwise alternatively associated with a vacuum assembly. Accordingly, the term "vacuum attachment 10" is not meant to be limiting in scope.

As discussed above, the vacuum adaptor 14 is configured to connect to a vacuum assembly 16 by any suitable mechanism that maintains the vacuum drawn by the vacuum assembly 16 through the vacuum adaptor 14 and a vacuum airflow path 18, discussed below. For example, the vacuum adaptor 14 may be configured to connect to the vacuum assembly 16 by snapping, screwing, clamping, being integrally formed, pressure fit, or otherwise securing the vacuum adaptor 14 and vacuum assembly 16 together. The vacuum adaptor 14 may be made of any suitable material that will not collapse on itself during the operation of the vacuum assembly 16. Preferably, the vacuum adaptor 14 is made of a rigid rubber material that enables a temporary seal between the vacuum adaptor 14 and the body 12, as well as enabling a temporary seal between the vacuum adaptor 14 and the vacuum assembly 16.

Figure 2:
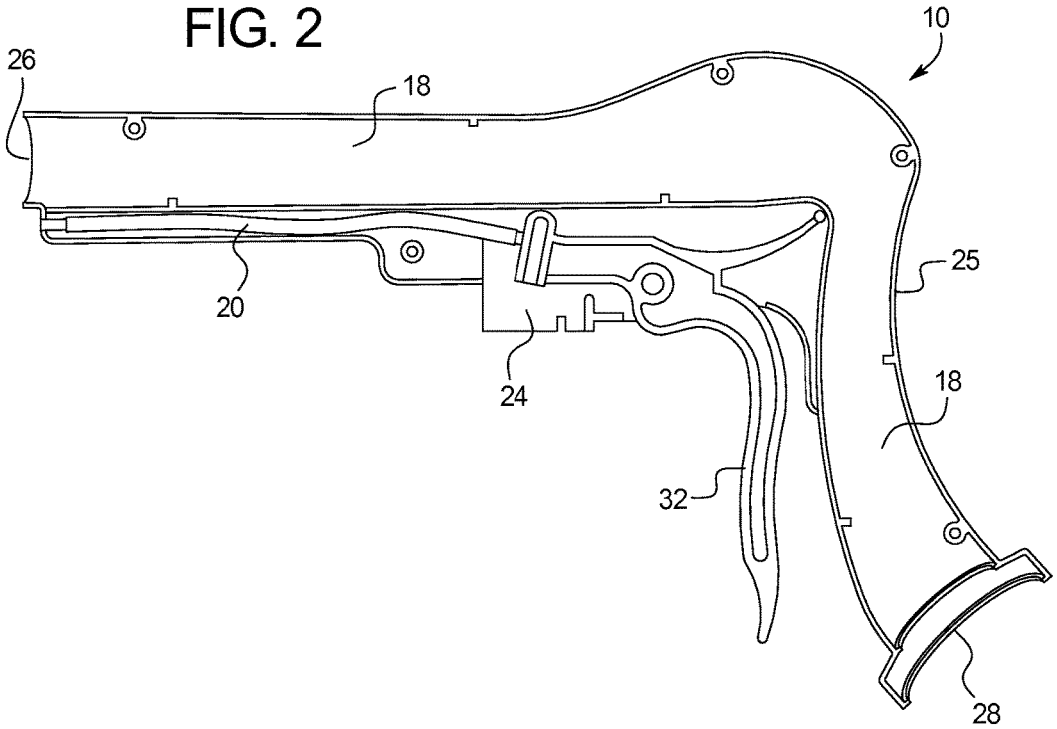
FIG. 2 is a sectional view of the vacuum attachment disclosed herein.
Figure 6:
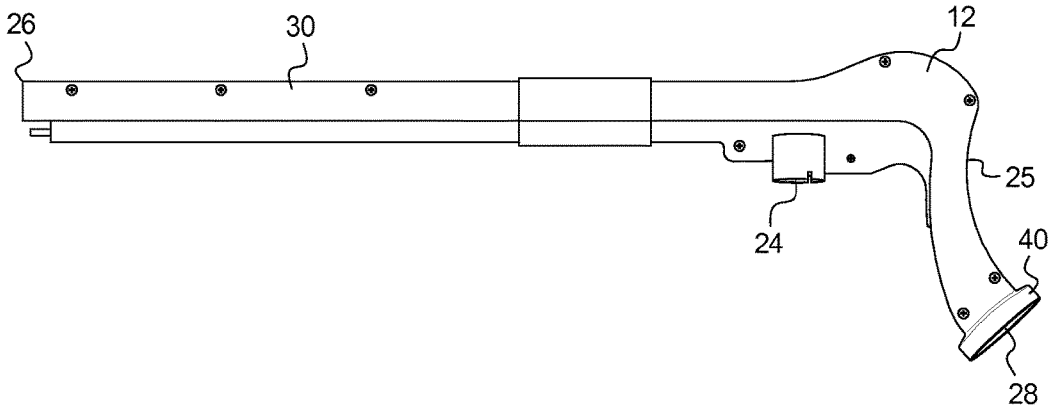
FIG. 6 is a side view of the vacuum attachment disclosed herein including an extension attachment.

The body includes a vacuum airflow path 18 configured to be in fluid communication with the vacuum assembly 16. As shown in FIG. 2, the vacuum airflow path 18 extends from a first end 26 to a second end 28, wherein the second end 28 receives the vacuum adaptor 14. The second end may include a flange 40, as shown in FIG. 6, that enables a user to easily grip the second end 28 as the vacuum adaptor 14 is inserted into the second end 28. Alternatively, the second end 28 may not include the flange 40 and, instead, include a partially cylindrical shape or tapered cylindrical shape that enables a seal between the second end 28 and the vacuum adaptor 14, such that the vacuum adaptor 14 may fit into or over the second end 28.

The body 12 further comprises a dispensing airflow path 20 configured to be in fluid communication with a pressurized gas source 22. As shown in FIG. 2, the dispensing airflow path 20 extends from a gas source adapter 24 to the first end 26 of the body 12. The vacuum airflow path 18 and dispensing airflow path 20 may be formed from any suitable materials. For example, the vacuum airflow path 18 may be made of any material that will not collapse upon activating the vacuum assembly. Preferably, the vacuum airflow path 18 is made of a rigid plastic, such as an injection molded plastic. The dispensing airflow path 20 may also be made of the rigid plastic material, but could also be made of flexible plastic tubing, as shown in FIG. 2.

Figure 3:
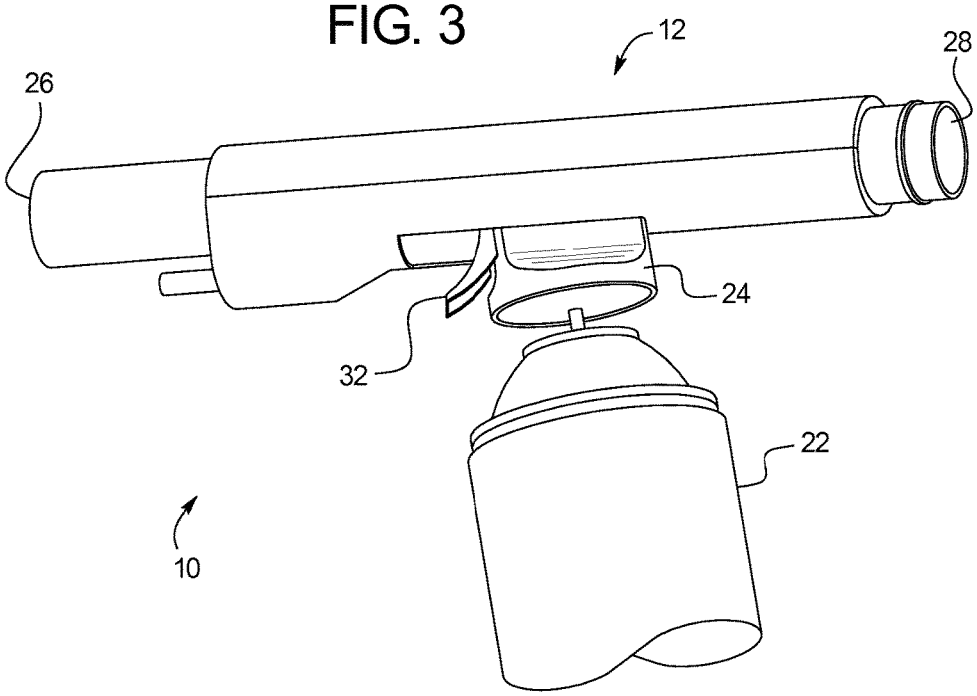
FIG. 3 is a perspective view of the vacuum attachment disclosed herein wherein the body of the device is linear.
Figure 4:
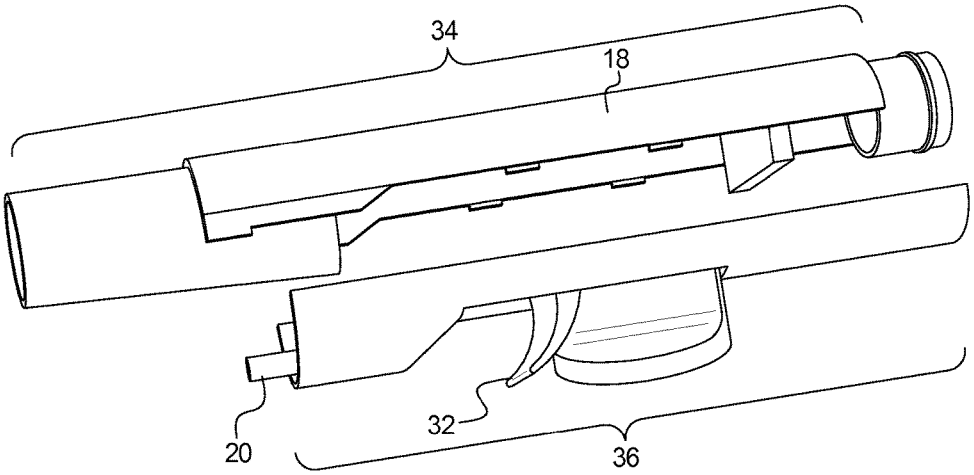
FIG. 4 is a perspective view of the vacuum attachment disclosed herein wherein the body includes two separate portions joined together.

Various shapes of the body are contemplated. For example, FIGS. 1-2 depict a body having an "L" shape, whereas FIGS. 3-4 depict a body having a linear shape. It is contemplated that the body 12 may be made of any suitable material. Most preferably, the body 12 is made of a rigid plastic. In an embodiment, the shape of the body 12 forms the path of the vacuum airflow path 18 and/or the path of the dispensing airflow path 20. The body 12 may be one continuous plastic body as show in FIGS. 1-2, or the body 12 may be made of at least two portions that fit together. For example, FIG. 4 depicts a body 12 having an upper portion 34 and lower portion 36 that fit together. The upper portion 34 may contain the vacuum airflow path 18 and the lower portion 36 may contain the dispensing airflow path 20. The upper portion 34 and lower portion 36 may simply snap together or may otherwise be joined in any manner apparent to those skilled in the art.

In addition, at least a portion of an outer surface of the body may be configured to be used as a handle 25 by a user. For example, as shown in FIG. 1, the outer surface of the body 12 is configured to enable a user to hold and direct the vacuum attachment 10 such that the dispensing airflow path 20 and vacuum airflow path 18 are positioned effectively to dislodge and capture dust and debris from a surface. In one embodiment, at least a portion of the vacuum airflow path 18 is positioned inside the handle 25, as shown in FIG. 2.

In an embodiment, the vacuum attachment 10 is configured to draw a vacuum through the vacuum airflow path 18 and dispense pressurized gas through the dispensing airflow path 20 simultaneously. For example, the dispensing airflow path 20 is configured to dispense high-pressure gas to dislodge dust from a surface and the vacuum airflow path 18 is configured to capture the dust particles dislodged by the pressurized gas.

Figure 7:
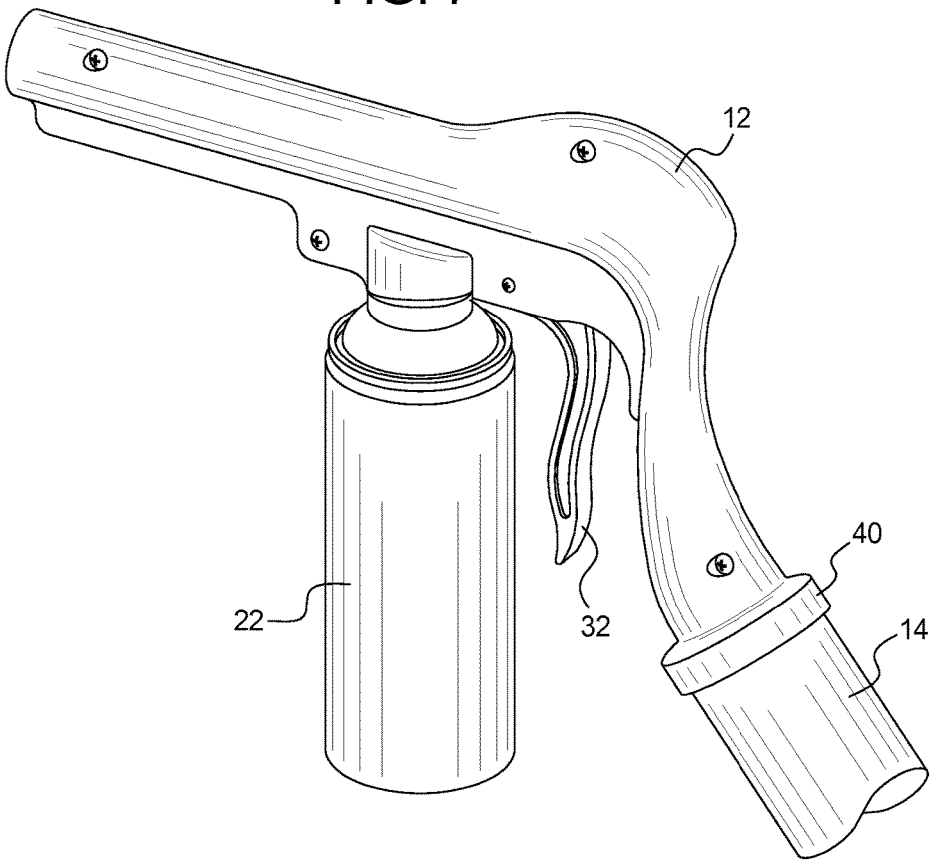
FIG. 7 is a side view of the vacuum attachment disclosed herein including a compressed gas source.

As shown in FIG. 2, the body 12 may further comprise a gas source adapter 24 configured to receive a pressurized gas source 22. As shown in FIGS. 2-3 and 7, the gas source adapter 24 is configured to receive a pressurized gas source 22, such as a compressed air duster canister. However, any suitable pressurized gas source 22 is contemplated by the invention. In one example, the pressurized gas source 22 may be a rechargeable type of compressed gas source 22 that may be refilled with pressurized gas upon completion. Further, instead of the compressed gas source 22, the device 10 may include an internal gas compressor including a motor that intakes surrounding air and converts it to compressed air.

Figure 9:
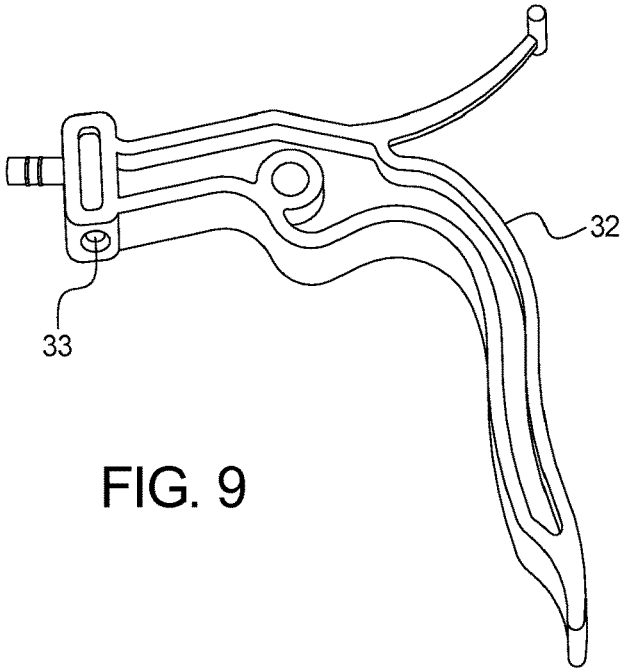
FIG. 9 is a side view of an embodiment of a trigger disclosed herein.

As shown in FIGS. 1-2, the device 10 may further include a trigger 32, wherein, upon engaging the trigger 32, pressurized gas may be dispensed from the pressurized gas source 22 through the dispensing airflow path 20. The trigger 32 may be configured to dispense gas as long as the trigger 32 is engaged until the trigger is released. Alternatively, the trigger 32 may be configured to release a pulse of air every time the trigger 32 is pressed. As shown in FIG. 9, the trigger 32 may include an input 33 that receives a stem of the pressurized air source, such that when the trigger 32 is engaged, the stem is pushed down, thereby releasing pressurized air through a channel in the trigger 32.

In a further example, the trigger 32 may be configured to release pressurized gas while simultaneously allowing the air to flow through the vacuum line. In other words, the trigger 32 may be configured to block the vacuum line when the trigger 32 is not engaged, and unblock the vacuum line when the trigger 32 is engaged. Alternatively, the trigger 32 may be configured to block the vacuum line when the trigger 32 is engaged.

Figure 5:
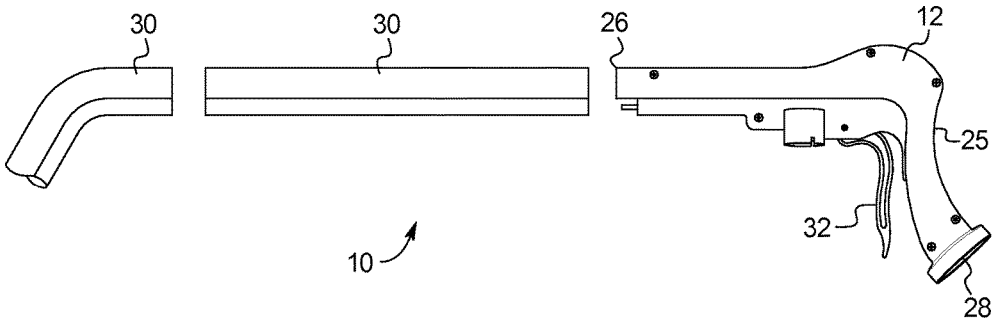
FIG. 5 is a side view of the vacuum attachment disclosed herein including an extension attachment.

As shown in FIGS. 5-6, the first end 26 may be configured to receive an extension accessory 30 configured to extend the distance between the first end 26 and the second end 28. The extension accessory 30 may be any suitable accessory that attaches to the first end 26 of the body 12. For example, as shown in FIG. 5, the extension accessory 30 may be a linear extension. However, various extension accessories 30 are contemplated, such as, brush attachments, cloth attachments, "L" shaped attachments, pointed or tapered attachments, etc. The extension accessory 30 may extend both the vacuum airflow path 18 and the dispensing airflow path 20. Such extension accessory 30 is particularly useful for dislodging and removing dust from hard to reach places, such as ceiling fans or tall bookshelves.

This disclosure also provides a method of dusting including providing a vacuum attachment 10 that includes a body 12 including a vacuum adaptor 14 configured to connect to a vacuum assembly 16. The vacuum attachment 10 further includes a vacuum airflow path 18 configured to be in fluid communication with the vacuum assembly 16 and a dispensing airflow path 20 configured to be in fluid communication with a pressurized gas source 22. The method includes attaching a vacuum assembly 16 to the vacuum adaptor 14 of the vacuum attachment 10 and activating the vacuum assembly 16 to draw a vacuum through the vacuum airflow path 18. The method further includes dispensing pressurized gas through the dispensing airflow path 20 onto a surface to be cleaned, dislodging dust from the surface into the air, and capturing at least a portion of the dislodged dust into the vacuum air flow path 18. The dispensing pressurized gas may include engaging a trigger 32 wherein, upon engaging the trigger 32, the trigger 32 is configured to dispense pressurized gas from the pressurized gas source 22 through the dispensing airflow path 20.

For example, FIG. 8 depicts a person using the vacuum attachment 10 to clean a cluttered toy basket. The vacuum attachment 10 is connected to a vacuum assembly 16 such that the vacuum assembly 16 pulls vacuum (i.e., low pressure) through the vacuum airflow path 18. The user can also engage the trigger 32 at his or her discretion when the user wants to dispense pressurized gas through the dispensing airflow path 20. In other words, while the vacuum assembly 16 draws a vacuum through the vacuum airflow path 18, pressurized gas may be dispensed at the user's discretion to dislodge dust from a surface, wherein the dust is captured by the vacuum airflow path 18. The method disclosed herein allows a surface to be dusted without physically touching the surface. Therefore, a surface that is littered with trinkets and other items can easily be dusted without having to remove all of the items from the surface in order to reach the surface.

It should be noted that various changes and modifications to the embodiments described herein will be apparent to those skilled in the art. Such changes and modifications may be made without departing from the spirit and scope of the present invention and without diminishing its attendant advantages. For example, various embodiments of the method and device may be provided based on various combinations of the features and functions from the subject matter provided herein.

I claim:

1. A vacuum attachment comprising:

a body including:

an adaptor configured to connect to a vacuum assembly, a vacuum airflow path configured to be in fluid communication with the vacuum assembly, and a dispensing airflow path, distinct from the vacuum airflow path, in fluid communication with a pressurized gas source, distinct from the vacuum assembly, wherein the dispensing airflow path and the vacuum airflow path are in a fixed directional relationship with respect to each other, such that an inlet to the vacuum airflow path into which air flows from an ambient source is adjacent to an outlet from the dispensing airflow path from which air flows into the ambient source such that air flowing into the vacuum airflow path moves in a direction opposing air flowing from the dispensing airflow path, and wherein the vacuum airflow path and the dispensing airflow path are isolated from one another such that air originating from the ambient source flows into the inlet and through the vacuum airflow path simultaneously and in isolation from gas originating from the pressurized gas source that flows through the dispensing airflow path into the ambient source.

2. The vacuum attachment of claim 1 wherein a handle includes the vacuum airflow path.

3. The vacuum attachment of claim 1 wherein the vacuum assembly draws a vacuum through the vacuum airflow path and dispenses pressurized gas through the dispensing airflow path simultaneously.

4. The vacuum attachment of claim 1 wherein the dispensing airflow path is configured to dislodge dust from a surface and wherein the vacuum airflow path is configured to simultaneously capture the dust particles dislodged by the pressurized gas.

5. The vacuum attachment of claim 1 wherein the body further comprises a gas source adapter configured to receive a pressurized gas source.

6. The vacuum attachment of claim 5 wherein the pressurized gas source is a compressed air duster canister.

7. The vacuum attachment of claim 1 further comprising a trigger, wherein, upon engaging the trigger, the trigger is configured to dispense pressurized air from the pressurized gas source through the dispensing airflow path.

8. The vacuum attachment of claim 1 wherein the body is in the shape of an "L".

9. The vacuum attachment of claim 1 wherein at least a portion of an outer surface of the body is configured to be used as a handle by a user.

10. The vacuum attachment of claim 1 wherein the vacuum airflow path extends from a first end of the body to a second end of the body, wherein the second end of the body includes the adaptor.

11. The vacuum attachment of claim 10 wherein the first end is configured to receive an extension accessory configured to extend the distance between the first end and second end.

12. A vacuum attachment comprising:

a body including:

an adaptor connected to a vacuum apparatus, a vacuum airflow path in fluid communication with the vacuum apparatus, and a dispensing airflow path, distinct from the vacuum airflow path, in fluid communication with a pressurized gas source, distinct from the vacuum apparatus, wherein the dispensing airflow path and the vacuum airflow path are in a fixed directional relationship with respect to each other, such that the vacuum airflow path includes an inlet at a first end of the body and the dispensing airflow path includes an outlet at the first end of the body, and wherein the vacuum airflow path and the dispensing airflow path are isolated from one another such that air originating from the ambient source flows into the inlet and through the vacuum airflow path simultaneously and in isolation from gas originating from the pressurized gas source that flows through the dispensing airflow path into the ambient source.

13. The vacuum attachment of claim 12 wherein a handle includes the vacuum airflow path and the vacuum airflow path extends from the first end of the body to a second end of the body, wherein the second end of the body includes the adaptor.

14. The vacuum attachment of claim 12 wherein the vacuum attachment draws a vacuum through the vacuum airflow path and dispenses pressurized gas through the dispensing airflow path simultaneously.

15. The vacuum attachment of claim 12 wherein the body further comprises a gas source adapter configured to receive a pressurized gas source.

16. The vacuum attachment of claim 15 wherein the pressurized gas source is a compressed air duster canister.

17. The vacuum attachment of claim 12 further comprising a trigger, wherein, upon engaging the trigger, the trigger is configured to dispense pressurized air from the pressurized gas source through the dispensing airflow path.

* * * * *